US009151257B2

(12) United States Patent
Jeon et al.

(10) Patent No.: US 9,151,257 B2
(45) Date of Patent: Oct. 6, 2015

(54) FUEL PUMP MODULE FOR SUPPLYING DIESEL FUEL

(75) Inventors: Munsik Jeon, Cheongju-si (KR); Chanheum Yoon, Yeongi-gun (KR); Dong-Heon Mo, Yeongi-gun (KR)

(73) Assignee: COAVIS (KR)

( * ) Notice: Subject to any disclaimer, the term of this patent is extended or adjusted under 35 U.S.C. 154(b) by 335 days.

(21) Appl. No.: 13/562,453

(22) Filed: Jul. 31, 2012

(65) Prior Publication Data

US 2013/0061960 A1 Mar. 14, 2013

(30) Foreign Application Priority Data

Sep. 14, 2011 (KR) ..... 10-2011-0092332

(51) Int. Cl.
*F02M 37/10* (2006.01)

(52) U.S. Cl.
CPC ..... *F02M 37/103* (2013.01); *F02M 37/106* (2013.01); *Y10T 137/794* (2015.04)

(58) Field of Classification Search
CPC ..... F02M 37/0035; F02M 37/103; F02M 37/106; F02M 2037/228
USPC ..... 137/565.22, 565.34; 123/509, 510, 511, 123/514, 445–465
See application file for complete search history.

(56) References Cited

U.S. PATENT DOCUMENTS

| | | | | |
|---|---|---|---|---|
| 4,187,813 | A * | 2/1980 | Stumpp | 123/510 |
| 4,574,762 | A * | 3/1986 | Muller et al. | 123/510 |
| 4,694,857 | A * | 9/1987 | Harris | 417/360 |
| 4,945,884 | A * | 8/1990 | Coha et al. | 123/509 |
| 5,218,942 | A * | 6/1993 | Coha et al. | 123/514 |
| 5,398,655 | A * | 3/1995 | Tuckey | 123/514 |
| 5,431,143 | A * | 7/1995 | Brown | 123/514 |
| 7,077,109 | B2 * | 7/2006 | Lee | 123/514 |
| 7,658,181 | B2 * | 2/2010 | Dickenscheid | 123/509 |
| 7,757,672 | B2 * | 7/2010 | Villaire et al. | 123/509 |
| 7,964,096 | B2 * | 6/2011 | Kimisawa et al. | 123/509 |
| 2003/0106537 | A1 * | 6/2003 | Isozaki et al. | 123/509 |

(Continued)

FOREIGN PATENT DOCUMENTS

| | | |
|---|---|---|
| CN | 201593467 | 9/2010 |
| KR | 1999003283 | 1/1999 |

(Continued)

OTHER PUBLICATIONS

Machine translation of KR 1075795 B1 Dated Oct. 2011 Korea, Republic Cho H et al.*

*Primary Examiner* — Craig Schneider
*Assistant Examiner* — Daniel P Donegan
(74) *Attorney, Agent, or Firm* — Cantor Colburn LLP

(57) ABSTRACT

Provided is a fuel pump module for supplying diesel fuel. The fuel pump module in accordance with exemplary embodiments of the present invention is configured to include a flange assembly fixed to an inlet of a fuel tank and a reservoir body assembly disposed in the fuel tank, wherein the reservoir body assembly includes: a filter that removes foreign objects included in the diesel fuel; a fuel pump that forcibly circulates the diesel fuel passing through the filter to a diesel engine; and a pump connection return passage that supplies fuel toward a diesel engine through a supply line of fuel but supplies the diesel fuel that is returned without being consumed by the diesel engine between the filter and the fuel pump to supply the fuel to the fuel pump without passing through the filter.

6 Claims, 6 Drawing Sheets

(56) References Cited

U.S. PATENT DOCUMENTS

| | | | | |
|---|---|---|---|---|
| 2010/0307615 | A1* | 12/2010 | Takahashi et al. | 137/544 |
| 2011/0174275 | A1* | 7/2011 | Lim et al. | 123/509 |
| 2013/0098339 | A1* | 4/2013 | Yoon et al. | 123/495 |
| 2013/0233283 | A1* | 9/2013 | Rinke et al. | 123/495 |
| 2013/0340723 | A1* | 12/2013 | Sharp | 123/514 |

FOREIGN PATENT DOCUMENTS

| | | | |
|---|---|---|---|
| KR | 101075795 | B1 * | 10/2011 |
| WO | 2007108285 | | 9/2007 |
| WO | WO 2007/108285 | A1 * | 9/2007 |

* cited by examiner

FUEL PUMP MODULE FOR SUPPLYING DIESEL FUEL

CROSS-REFERENCE TO RELATED APPLICATIONS

This application claims priority under 35 U.S.C. §119 to Korean Patent Application No. 10-2011-0092332, filed on Sep. 14, 2011, in the Korean Intellectual Property Office, the disclosure of which is incorporated herein by reference in its entirety.

TECHNICAL FIELD

The following disclosure relates to a fuel pump module for supplying diesel fuel capable of supplying diesel fuel to a diesel engine mounted in a diesel vehicle, or the like.

BACKGROUND

Engines mounted in various vehicles are divided into a gasoline engine, a diesel engine, and an LPG engine according to use fuel.

Further, the vehicle includes a fuel tank for supplying fuel to an engine and a fuel pump module for forcibly supplying the fuel in the fuel tank to an engine.

Generally, as shown in FIGS. 1 and 2, the fuel pump module is configured to include a flange assembly 10, a reservoir body assembly 20, a guide rod 25 connecting the flange assembly 10 with the reservoir body assembly 20, a spring 26 disposed at outside of the guide rod 25, a filter 28 for removing foreign objects included the fuel, and a fuel pump 27 for forced circulation.

This structure can be confirmed through Korean Utility Model Application No. 20-1997-0016877 (Utility Model Registration No. 20-0160774), or the like.

In most cases, the flange assembly 10 is fixed to an inlet part of the fuel tank and the reservoir body assembly 20 is disposed at a bottom of the tank.

In addition, the guide rod 25, which connects the flange assembly with the reservoir body assembly while guiding a motion of the spring, is formed to be slid inwardly of the reservoir body assembly.

In addition, the spring 26 is disposed at the outside of the guide rod 25 and is disposed between the flange assembly and the reservoir body assembly so that the reservoir body assembly is disposed at the bottom of the fuel tank at all times.

The diesel engine, which is an engine that uses the diesel fuel such as diesel oil to generate an output, cannot smoothly supply fuel in a low-temperature region below zero even though the vehicle has the above-mentioned fuel pump module for forcibly supplying the fuel.

That is, the diesel fuel such as diesel oil, or the like, becomes clotted and crystallized in a paraffin form even in the low-temperature region (usually, a temperature region below zero), or the like, and thus, cannot be easily supplied through the fuel pump module. Therefore, starting performance of the diesel engine may be poor in the low-temperature region below zero and a driving of the engine may not be smoothly performed.

RELATED ART DOCUMENT

Patent Document (Patent Document 1) KR Utility Model Application No. 20-1997-0016877

SUMMARY

An embodiment of the present invention is directed to providing a fuel pump module supplying for diesel fuel capable of supplying the diesel fuel so as to ensure smooth starting performance and driving performance of a diesel engine even in a low-temperature region in which the diesel fuel becomes clotted in a paraffin form, or the like.

An exemplary embodiment of the present invention ensures a smooth starting performance and a smooth driving performance of the diesel engine even in the low-temperature region by supplying fuel toward a diesel engine and then, supplying again the fuel that is returned without being consumed by the diesel engine via a fuel pump, which is one of the components of a fuel pump module, and directly supplying the fuel to the fuel pump without passing through a filter filtering the foreign objects before foreign objects included in the fuel in the fuel tank are supplied to the fuel pump.

The fuel pump module for supplying diesel fuel in accordance with the exemplary embodiment of the present invention may include a flange assembly fixed to an inlet of the fuel tank.

Further, the fuel pump module may include a reservoir body assembly disposed in the fuel tank.

In addition, the reservoir body assembly may include the filter for removing foreign objects included in the diesel fuel.

Further, the fuel pump module may include the fuel pump for forcibly circulating the diesel fuel passing through the filter to the diesel engine.

Further, the fuel pump module may include a pump connection return passage that supplies the diesel fuel supplied toward the diesel engine through the supply line of fuel but returned without being consumed by the diesel engine to the fuel pump without passing through the filter.

Other features and aspects will be apparent from the following detailed description, the drawings, and the claims.

DETAILED DESCRIPTION OF EMBODIMENTS

The advantages, features and aspects of the present invention will become apparent from the following description of the embodiments with reference to the accompanying drawings, which is set forth hereinafter. The present invention may, however, be embodied in different forms and should not be construed as limited to the embodiments set forth herein. Rather, these embodiments are provided so that this disclosure will be thorough and complete, and will fully convey the scope of the present invention to those skilled in the art. The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Hereinafter, a technical idea of the present invention will be described in more detail with reference to the accompanying drawings.

However, the accompanying drawings are only examples shown in order to describe the technical idea of the present invention in more detail. Therefore, the technical idea of the present invention is not limited to shapes of the accompanying drawings.

Figure 1:
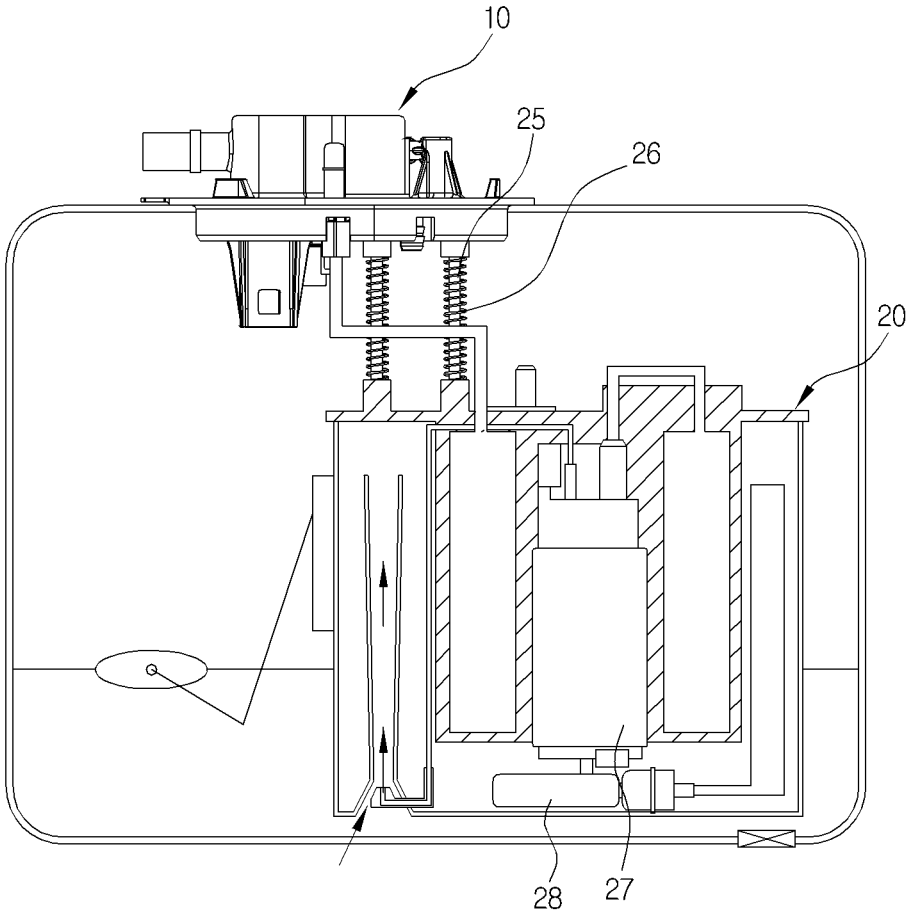
FIG. 1 Prior Art
FIG. 1 is a schematic cross-sectional view for describing a typical fuel pump module and a mounting state thereof.
Figure 2:
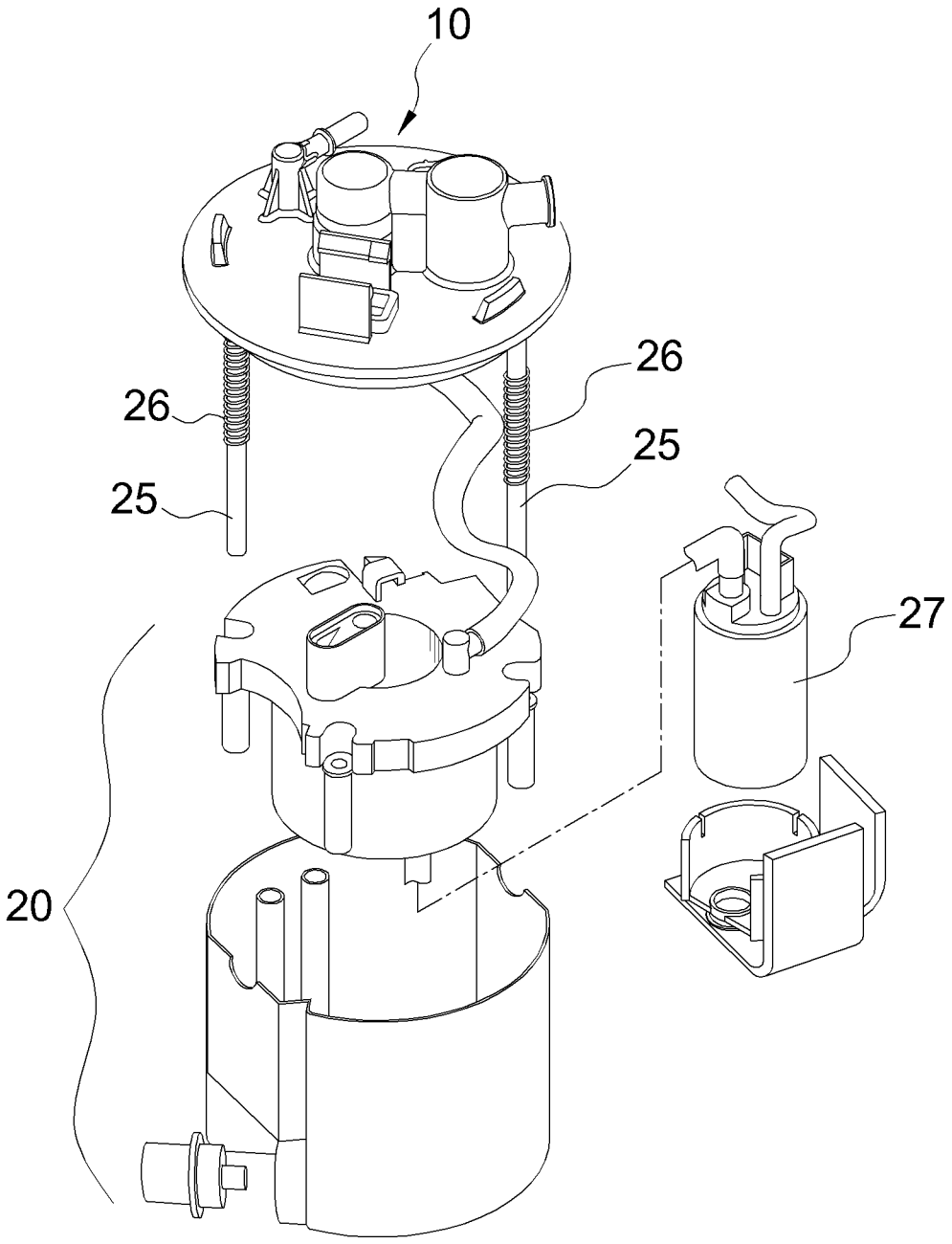
FIG. 2 Prior Art
FIG. 2 is an exploded perspective view for describing the typical fuel pump module.
Figure 3:
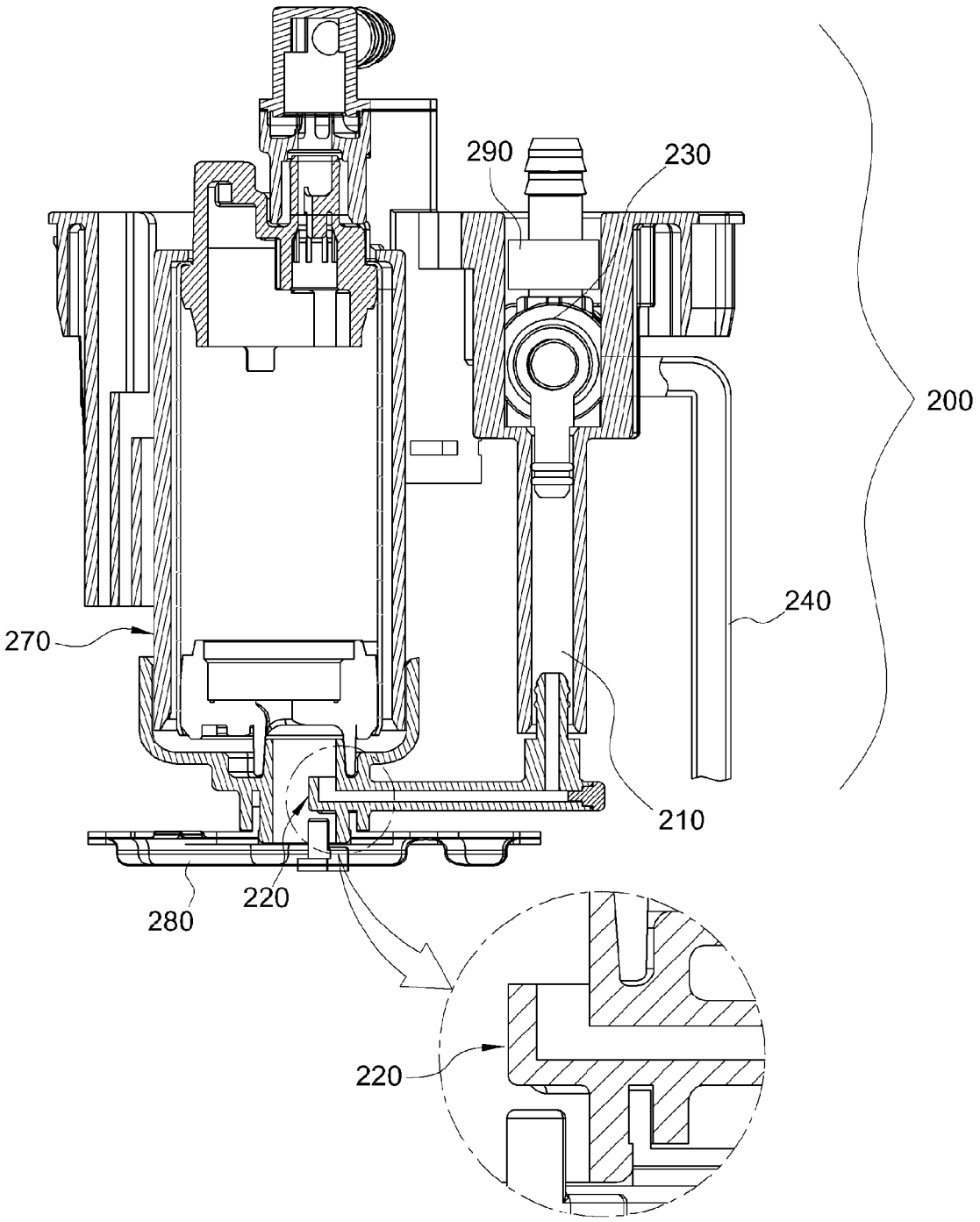
FIG. 3 is a schematic cross-sectional view showing a reservoir body assembly that is a component of a fuel pump module for describing the fuel pump module to which a technical idea of the present invention is applied.
Figure 4:
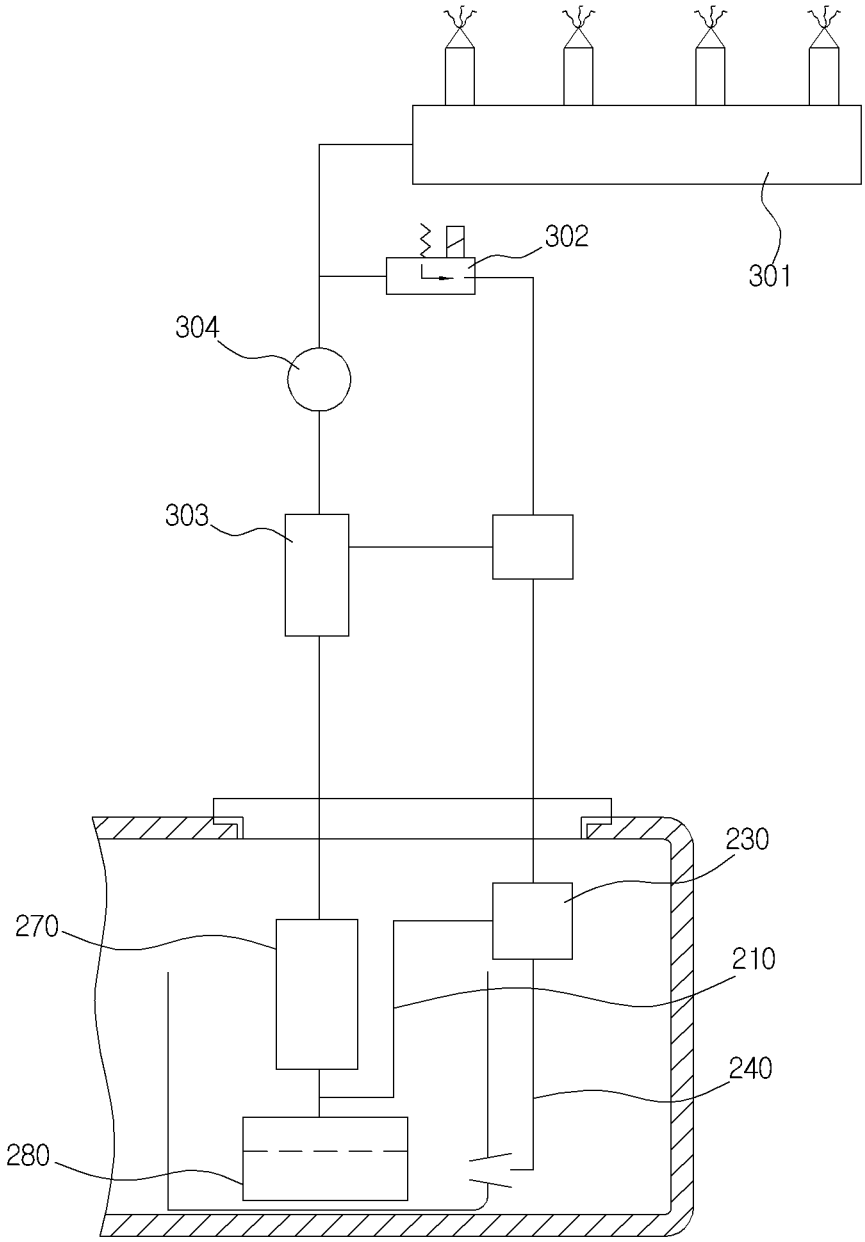
FIG. 4 is a schematic diagram for describing a structure of supplying diesel fuel using the fuel pump module in accordance with an exemplary embodiment of the present invention.
Figure 5:
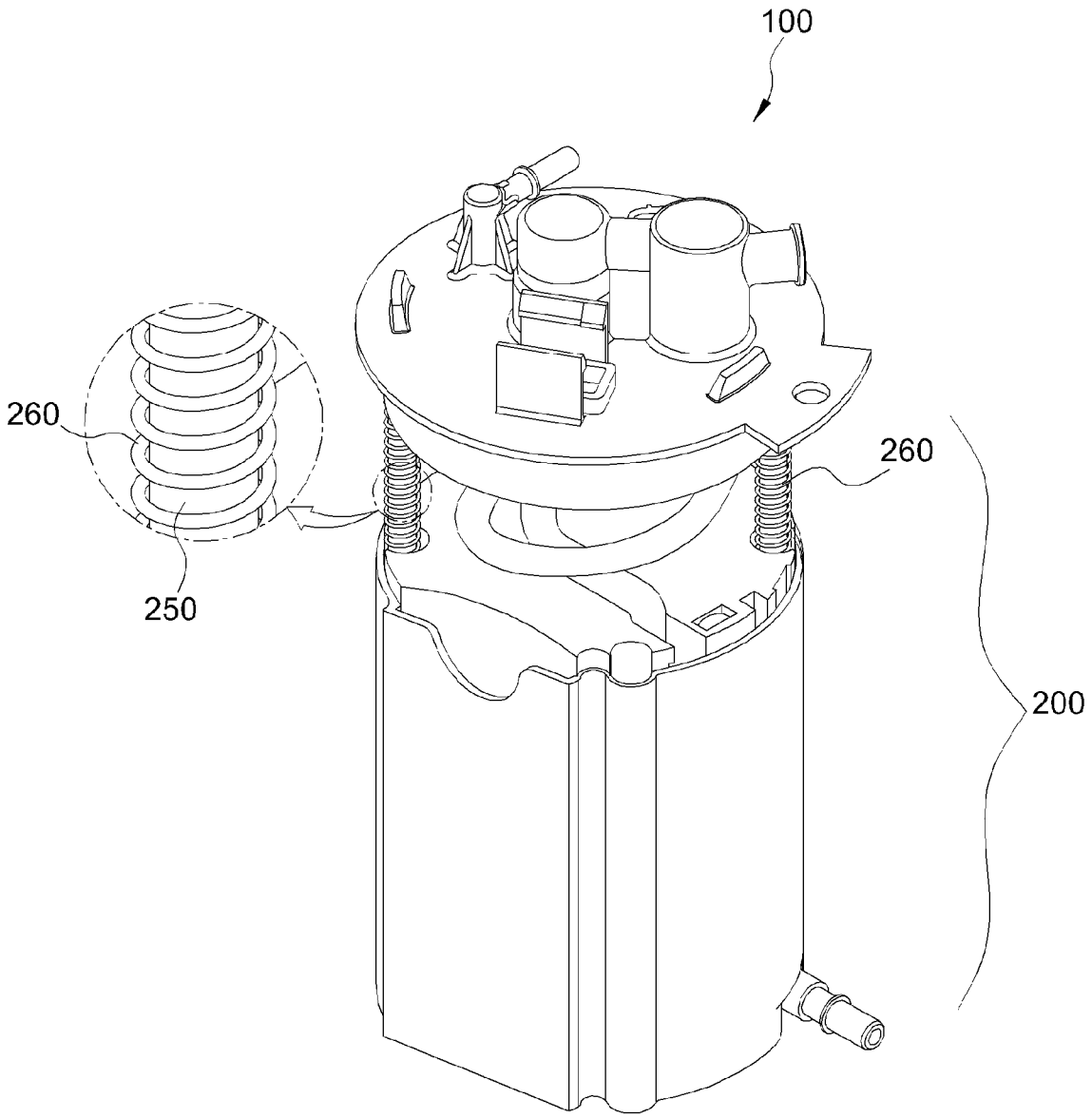
FIG. 5 is a schematic perspective view of the fuel pump module for supplying diesel fuel in accordance with the exemplary embodiment of the present invention.
Figure 6A:
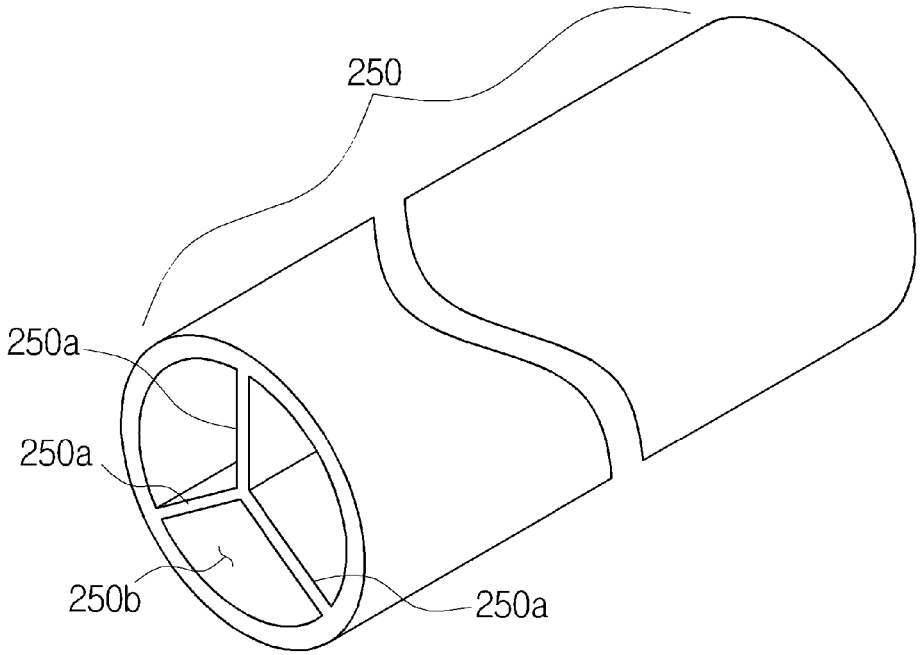
FIG. 6A is a perspective view of the guide rod having a hollow partitioned by a rib.
Figure 6B:
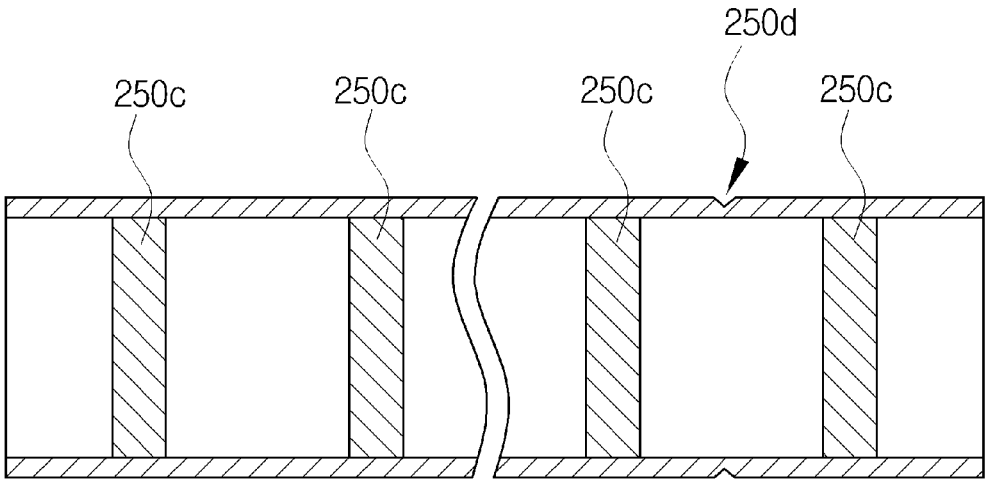
FIG. 6B is a cross-sectional view of the guide rod provided with a strength reinforcing body at a distance in a length direction and provided with a breakage inducing part.

FIG. 3 is a schematic cross-sectional view showing a reservoir body assembly that is a component of a fuel pump module for describing the fuel pump module to which a technical idea of the present invention is applied. FIG. 4 is a schematic diagram for describing a structure of supplying diesel fuel using the fuel pump module in accordance with an exemplary embodiment of the present invention. FIG. 5 is a schematic perspective view of the fuel pump module for supplying diesel fuel in accordance with the exemplary embodiment of the present invention. FIG. 6A is a perspective view of the guide rod having a hollow partitioned by a rib. FIG. 6B is a cross-sectional view of the guide rod provided with a strength reinforcing body at a distance in a length direction and provided with a breakage inducing part.

Exemplary embodiments of the present invention relate to a fuel pump module for supplying diesel fuel to the diesel engine.

In a normal driving state, a structure for supplying diesel fuel in a fuel tank to a diesel engine may be implemented in the same structure as the related art.

That is, like the related art, the fuel pump module in accordance with the exemplary embodiment of the present invention is configured to include a flange assembly 100, a reservoir body assembly 200, a guide rod 250, a spring 260, a fuel pump 270, and a filter 280.

However, the exemplary embodiment of the present invention is to provide the fuel pump module for supplying diesel fuel so as to ensure a smooth starting performance and a smooth driving performance of the diesel engine even in the low-temperature region in which the diesel fuel becomes clotted in the paraffin form, or the like.

For this reason, the exemplary embodiment of the present invention supplies the diesel fuel toward a diesel engine through a supply line of fuel but again supplies fuel that is returned without being consumed by the diesel engine toward a fuel tank to the supply line of fuel.

A technology of returning the diesel fuel that is not consumed by the diesel engine toward the fuel tank (around the fuel tank or the fuel pump module) is already known.

However, an object of the present invention cannot be achieved only by the structure of simply supplying the returned fuel toward the fuel tank and again supplying the returned fuel together with the fuel in the fuel tank in accordance with the related art.

When a large amount of fuel is filled in the fuel tank and the fuel of the fuel tank becomes clotted in the paraffin form, it is difficult to make the fuel clotted in the paraffin form in a normal state and to continuously drive the diesel engine even though the returned fuel is supplied to the fuel tank.

For this reason, the exemplary embodiment of the present invention supplies the returned fuel to the supply line (a line supplying the diesel fuel in the fuel tank to the diesel engine) of the fuel.

Further, the fuel pump module includes a pump connection return passage 210 supplying fuel to a point from which fuel may be supplied to the fuel pump 270, without passing through a filter 280 (a filter disposed under the fuel pump module to prevent the foreign objects from being reached a fuel pump 270 of the fuel pump module) filtering foreign objects from the fuel in the fuel tank.

That is, the diesel engine can be driven until the fuel clotted in the paraffin form within the fuel tank may be melted in a normal state by supplying the returned fuel toward the diesel engine while preventing the loss of the returned fuel.

About 10% of the fuel supplied through the fuel pump module is consumed by the diesel engine and about 90% thereof is generally returned. Therefore, the diesel engine can be driven for considerable time so as to prevent the fuel that is returned through the pump connection return passage 210 from being lost.

Since the temperature of the returned diesel fuel due to heat generated increases during the driving of the diesel engine by the returned fuel and the temperature of the filter 280 of the fuel pump module and the diesel fuel around the filter 280 increase due to the temperature of the returned diesel fuel, or the like, the diesel fuel is in a normal state.

The diesel fuel can naturally be supplied to the diesel engine by the fuel pump module when the temperature of the fuel around the filter 280 is increased and thus, the fuel is in a normal state.

When the returned diesel fuel moves in the filter 280 direction, the loss of the returned diesel fuel may be increased. Therefore, the fuel pump module may further include the return fuel guide part 220 that guides the movement of the returned fuel so as not to move the returned diesel fuel in the filter 280 direction, as shown in FIG. 3.

In the accompanying drawings, the return fuel guide part 220 is bent toward the fuel pump 270 so as to discharge the returned fuel only in the fuel pump 270 while forming the end portion of the pump connection return passage 210.

However, when the diesel fuel is supplied to the diesel engine even in the normal driving state, not in the low-temperature region, a cavitation phenomenon, or the like, occurs, which results in hindering the stability of the fuel supply.

That is, as the temperature of the returned diesel fuel and the returning frequency of the returned diesel fuel are increased, the temperature of the returned diesel fuel is more increased.

Further, when the high-temperature diesel fuel is supplied to the diesel engine, the cavitation phenomenon, or the like, occurs, which results in deteriorating the stability of the fuel supply.

Therefore, supplying the returned fuel to the diesel engine through the supply line of fuel needs to be performed only in the restrictive conditions when the fuel in the fuel tank becomes clotted in the paraffin form, or the like.

For this reason, as shown FIGS. 3 and 4, the fuel pump module may further include a valve 230 for supplying the returned fuel to the fuel pump 270 through the pump connection return passage 210 without passing through the filter 280 only when the temperature of the fuel is a predetermined temperature or less.

That is, the returned fuel is supplied to the supply line of the fuel through the pump connection return passage 210 by the valve 230 and is thus supplied to the diesel engine under the conditions (on the conditions that the fuel in the fuel tank becomes clotted in the paraffin form, that is, fuel temperature, or the like where it is difficult to perform the normal driving) and the returned fuel is supplied via a normal driving return passage 240 under the normal driving conditions, such that the returned fuel is supplied while being mixed with the fuel of the fuel tank. (Under the normal conditions, the returned fuel is mixed with the fuel in the fuel tank and then supplied toward the engine via the filter 280).

A unit for sensing the temperature of fuel to drive the valve 230 may be implemented in a form having a bimetal, a temperature sensing sensor, or the like, and may be implemented in a form in which the passage is opened and closed by the change in temperature of a material.

Further, the valve may include the bimetal, the temperature sensing sensor, or the like.

The fuel to be temperature-sensed to drive the valve 230 may be fuel disposed in the valve 230 and may be fuel disposed at the outside of the fuel pump module while being in the fuel tank.

Reference numeral 301 in FIG. 4 is a fuel jetting rail, reference numeral 302 is a pressure control valve, reference numeral 303 is a fine filter, and reference numeral 304 is a high-pressure pump.

Meanwhile, as shown in FIG. 5, in the exemplary embodiment of the present invention, the fuel pump module include the guide rod 250 that can be cut at an appropriate length according to a specification of the fuel pump module, thereby making it possible to increase production and reduce an economic burden due to a stock.

To this end, the exemplary embodiment of the present invention proposes the structure in which the guide rod 250 extruded with synthetic resin is used (in the related art, all the guide rods are made of only metal).

That is, the guide rod 250 extruded with the synthetic resin can be easily cut to have an appropriate length according to the specification of the fuel pump module.

Further, the flange assembly 100 and the reservoir body assembly 200 are made of a synthetic resin material and may thus be firmly joined (assembled) with the flange assembly 100 or the reservoir body assembly 200 by a fusion method, or the like, which may be easily performed.

Further, the extruded long guide rod 250 can be cut according to the specification of the fuel pump module, such that manufacturers can reduce a stock burden and each include a mold for forming.

However, the guide rod 250 needs to satisfy a predetermined strength condition capable of enduring predetermined warpage stress, or the like.

As an extruded material of the guide rod 250, a high strength material such as glass fiber, or the like, may be used. However, it is difficult to reinforce the strength by only properties of the material.

To this end, as the guide rod 250, ones extruded in a form having an inner hollow space 250*b* partitioned by a rib 250*a* as shown in FIG. 6A may be used.

Further, as the guide rod 250, ones extruded to dispose a strength reinforcing body 250*c* at a distance in a longitudinal direction may be used, as shown in FIG. 6B.

That is, the guide rod 250 is a guide rod extruded by inserting the strength reinforcing body 250*c* thereinto, wherein the guide rod 250 is made of metal having relatively stronger strength than main materials for extruding the guide rod 250 in accordance with the exemplary embodiment of the present invention or materials such as carbon nano composite fiber, or the like.

Since the strength reinforcing body 250*c* as described above is disposed at a predetermined distance, the cutting point is between the strength reinforcing bodies, such that the length of the guide rod 250 can be cut at a size according to the specification of the fuel pump module.

Further, the fuel pump module may be implemented in a structure having the strength reinforcing body 250*c* while having the inner hollow space 250*b* partitioned by the rib 250*a*.

A method for disposing and extruding the strength reinforcing body 250*c* may be performed by using a method of introducing an object into a hollow of a material extruded in an extruding field.

The guide rod 250 may be implemented so as to pass current therethrough.

The guide rod 250 passing current therethrough may be implemented by mixing a conductive material such as carbon, or the like, with a synthetic resin material for extruding and then, extruding the mixed material.

When the guide rod 250 passes current therethrough, an electrostatic prevention effect can be obtained.

In the exemplary embodiment of the present invention, as shown in FIG. 6B, a shear inducing part 250*d* having lower shear strength than that of a connection part with the flange assembly 100 or a connection part with the reservoir body assembly 200 may be disposed between the connection part with the flange assembly 100 and the connection part with the reservoir body assembly 200 in the guide rod 250.

That is, the fuel pump module for a vehicle generally is a unit for preventing fuel from being leaked due to a traffic accident, or the like and forms the shear inducing part to prevent other parts thereof from being broken while generating the shear at the bottom point of the flange assembly 100 when impact is applied thereto.

In accordance with to the related art, the shear inducing part is formed in the flange assembly, which results in making repair and replacement works difficult and increasing replacement costs.

In accordance with the exemplary embodiment of the present invention, when the shear inducing part 250*d* is formed in the guide rod 250, the flange assembly 100 or the reservoir body assembly 200 is not broken but the guide rod 250 that is relatively inexpensive and can be easily repaired is broken, at the time of the generation of impact due to the traffic accident, or the like, thereby reducing the repair and replacement costs while preventing the fuel from being leaked.

In the exemplary embodiment of the present invention, as shown in FIG. 3, a check valve 290 may be provided to prevent the diesel fuel introduced into the pump connection return passage 210 from flowing backward.

According to the above configuration, the pressure of the return line is maintained and thus, the initial starting performance can be improved.

That is, even after the engine stops, the residual pressure is maintained and thus, the starting performance can be improved at the time of restarting.

The exemplary embodiments of the present invention can supply fuel so as to ensure the smooth starting performance and driving performance of the diesel engine even in the low-temperature region by supplying the fuel toward the diesel engine and then, supplying again the fuel that is returned without being consumed by the diesel engine to the diesel engine via the fuel pump of the fuel pump module but directly supplying the fuel to the fuel pump without passing through the filter (filter filtering the foreign objects before the foreign objects are included in the fuel in the fuel tank reaches the fuel pump) that is one of the components of the fuel pump module.

Further, the exemplary embodiments of the present invention can ensure stable fuel supply of fuel when the fuel pump module further includes the valve supplying the fuel to the fuel pump without passing the fuel that is returned through the filter only when the fuel is below the predetermined temperature.

In addition, the exemplary embodiments of the present invention can drive the engine using the return fuel for a longer period of time when the fuel pump module further includes the return fuel guide part guiding the circulation of the returned fuel without circulating the returned fuel in the filter direction.

What is claimed is:

1. A fuel pump module for supplying diesel fuel including a flange assembly fixed to an inlet of a fuel tank and a reservoir body assembly disposed in the fuel tank and a guide rod connecting the flange assembly with the reservoir body assembly, wherein the reservoir body assembly includes;

a filter that removes foreign objects included in the diesel fuel;

a fuel pump that forcibly circulates the diesel fuel passing through the filter to a diesel engine;

a pump connection return passage that supplies diesel fuel toward a diesel engine through a supply line of fuel but is returned without being consumed by the diesel engine between the filter and the fuel pump to supply the fuel to the fuel pump without passing through the filter;

wherein the guide rod extruded with a synthetic resin and extruded in a form having a hollow partitioned by a rib connects the flange assembly with the reservoir body assembly.

2. The fuel pump module of claim 1, further comprising: a return fuel guide part bent toward the fuel pump so as to discharge the returned fuel only in the fuel pump while forming an end portion of the pump connection return passage so that the returned fuel is not circulated in the filter direction.

3. The fuel pump module of claim 1, further comprising a check valve that prevents the diesel fuel introduced into the pump connection return passage from flowing backward.

4. The fuel pump module for supplying diesel fuel of claim 1, further comprising a valve that supplies the returned fuel to the fuel pump through the pump connection return passage when the fuel is a predetermined temperature or less and supplies the returned fuel so as to be mixed with the fuel of the fuel tank through a normal driving return passage when the fuel is a predetermined temperature or more.

5. The fuel pump module of claim 4, wherein the valve is driven by sensing the temperature of the fuel by a bimetal or a temperature sensing sensor.

6. The fuel pump module of claim 4, further comprising a return fuel guide part bent toward the fuel pump so as to discharge the returned fuel only in the fuel pump while forming an end portion of the pump connection return passage so that the returned fuel is not circulated in the filter direction.

* * * * *